US007104012B1

(12) United States Patent
Bayram

(10) Patent No.: US 7,104,012 B1
(45) Date of Patent: Sep. 12, 2006

(54) GUTTER GUARD

(76) Inventor: Coskun John Bayram, 140 Knickerbocker Ave., Paterson, NJ (US) 07503

( * ) Notice: Subject to any disclaimer, the term of this patent is extended or adjusted under 35 U.S.C. 154(b) by 195 days.

(21) Appl. No.: 10/886,242

(22) Filed: Jul. 7, 2004

(51) Int. Cl.
*E04D 13/064* (2006.01)
*E04D 13/076* (2006.01)
*E04D 3/02* (2006.01)

(52) U.S. Cl. ..... 52/12; 52/11; 219/213

(58) Field of Classification Search ..... 52/12, 52/11, 15, 97, 302.3; 219/213; 210/474; 137/357
See application file for complete search history.

(56) References Cited

U.S. PATENT DOCUMENTS 2,111,251 A * 3/1938 Spilsbury ..... 52/94
4,010,577 A * 3/1977 Stalter ..... 52/1
4,308,696 A * 1/1982 Schroeder ..... 52/11
4,404,775 A 9/1983 Demartini
4,435,925 A 3/1984 Jefferys
4,467,570 A * 8/1984 Kriegel ..... 52/12
4,497,146 A 2/1985 Demartini
4,769,526 A * 9/1988 Taouil ..... 219/213
4,796,390 A 1/1989 Demartini
5,010,696 A * 4/1991 Knittel ..... 52/12
5,056,276 A * 10/1991 Nielsen et al. ..... 52/12
5,072,551 A 12/1991 Manoogian, Jr.
5,457,916 A * 10/1995 Tenute ..... 52/12
5,557,891 A 9/1996 Albracht
5,640,809 A * 6/1997 Iannelli ..... 52/12
5,660,001 A 8/1997 Albracht
5,786,563 A 7/1998 Tiburzi
5,813,173 A * 9/1998 Way, Sr. ..... 52/12
5,836,344 A * 11/1998 Hovi, Sr. ..... 137/357
6,098,344 A * 8/2000 Albracht ..... 52/12
6,708,452 B1 * 3/2004 Tenute ..... 52/11
6,759,630 B1 * 7/2004 Tenute ..... 219/213
6,883,760 B1 * 4/2005 Seise, Jr. ..... 248/48.1

FOREIGN PATENT DOCUMENTS

JP 5-202589 * 8/1993 ..... 52/11
WO WO 95/02100 * 1/1995 ..... 52/12

OTHER PUBLICATIONS

Printout from website, www.guttercap.com, Jul. 7, 2004, 2 pages.
Printout from website, www.guttertopper.com, Jul. 7, 2004, 3 pages.
Printout from website, www.hallettent.com, Jul. 7, 2004, 1 page.
Printout from website, www.guttersdirect.com, Nov. 13, 2002, 1 page.
Printout from website, www.gutterleaf.com, Nov. 13, 2002, 1 page.
Printout from website, www.waterloov.com, Nov. 13, 2002, 1 page.

* cited by examiner

*Primary Examiner*—Phi Dieu Tran A
(74) *Attorney, Agent, or Firm*—Richard M. Goldberg

(57) ABSTRACT

A gutter guard includes a first inclined section for insertion below shingles of a roof; a second inclined section; and a securing section securing a front end of the gutter guard to a gutter of the roof. A first S-shaped drainage section connects the first inclined section to the second inclined section, and is positioned above an open end of the gutter for draining water thereinto. A second drainage section connects the second inclined section with the securing section, and is positioned above the open end of the gutter for draining water thereinto. The drainage sections each include a forwardly facing convex surface around which water travels, and openings at positions below the convex surfaces through which water exits into the gutter. A heating wire is positioned in the S-shaped drainage section.

16 Claims, 4 Drawing Sheets

GUTTER GUARD

BACKGROUND OF THE INVENTION

The present invention relates generally to guards for rain gutters on buildings, and more particularly, is directed to a gutter guard having two drainage sections and a heating mechanism associated therewith.

It is well-known to provide guards on top of gutters to prevent leaves from falling into the gutters, while permitting water to drain into the gutters. Examples of known arrangements presently being sold are, for example, the system sold under the registered trademark "GUTTER TOPPER" by Gutter Topper Ltd., L.L.C. Of Amelia, Ohio; the system sold under the registered trademark "GUTTER CAP" by Selective Seamless Siding Co. of Naperville, Ill.; and the system sold under the registered trademark "LEAFPROOF" by Eran Industries, Inc. of Omaha, Nebr.

In these systems, the gutter guard includes a sheet of metal that covers the gutter, and has a curved forward end that extends back into the gutter. Thus, leaves and the like are prevented from entering the gutter, but because of surface tension, water flows along the forward curvature of the guard and falls through small openings thereat into the gutter, where the water is carried away to the down spout.

One problem with these systems is that during a heavy water flow, because of the large volume of water, much of the rain water will tend to fall off the roof from the curved end of the gutter guard, rather than flow around the curved end into the gutter. In such case, the gutter guard, although preventing leaves and the like from entering the gutter, does not provide the function of guiding the rain water into the gutter.

In an attempt to solve this problem, U.S. Pat. No. 4,404,775 to Demartini discloses a gutter guard in which there are bumps to slow down the velocity of the rain water so that it travels around the bend into the gutter. U.S. Pat. No. 5,557,891 to Albracht discloses a gutter guard having water slowing means in the form of an S-shaped bend spaced rearwardly of the forward curved portion.

However, the problem with these approaches is that, during heavy rain, there is still too much rain water, so that much of the rain water will still fall off the roof from the curved end of the gutter guard, and will not travel by surface tension around the curved front end, into the gutter.

Another problem with such gutter guards is that ice and snow tend to accumulate thereon, which impedes the flow of water, and or, defeats the surface tension aspect so that the water falls from the roof at the curved end of the gutter guard.

Various proposals have been presented for adding heating elements to gutter guards in order to avoid this problem. For example, U.S. Pat. No. 4,308,696 to Schroeder discloses a gutter guard having heating elements as lengthwise extending strips on the flat upper surface portion of the gutter guard. U.S. Pat. No. 4,769,526 to Taouil discloses bent, raised portions extending along the length thereof, with heating cables positioned to the lower surface of the bent, raised portions. The heating cables are positioned between the roof and the gutter guard. In order to retain the heating cables in place during assembly, a dielectric adhesive-tape secures the cables in the bent, raised portions. U.S. Pat. No. 5,786,563 to Tiburzi discloses modular ice and snow removal heating panels for a gutter guard system having a built-in flexible heating layer.

However, none of these proposals are entirely satisfactory in that they are complex and burdensome to assemble, and are costly.

OBJECTS AND SUMMARY OF THE INVENTION

Accordingly, it is an object of the present invention to provide a gutter guard that overcomes the problems with the aforementioned prior art.

It is another object of the present invention to provide a gutter guard having two spaced apart drainage sections, both of which drain separately into the gutter.

It is still another object of the present invention to provide a gutter guard in which the first drainage section removes water during a heavy rain so that the remaining water travels around the curved free end by surface tension into the gutter through the second drainage section.

It is a yet another object of the present invention to provide a gutter guard in which the first and second drainage sections have similar shapes and functions.

It is a further object of the present invention to provide a gutter guard having a heating wire mounted in the upstream first drainage section for heating the gutter guard to melt any snow or ice thereon.

It is a still further object of the present invention to provide a gutter guard in which the S-shape of the upstream first drainage section holds, secures and protects the heating wire.

In accordance with an aspect of the present invention, a gutter guard includes a first inclined section of water impervious material having a rear end adapted for insertion below shingles of a roof of a building; a second inclined section of water impervious material; and a securing section for securing a front end of the gutter guard to a gutter of the building. A first drainage section connects a front end of the first inclined section to a rear end of the second inclined section. When the rear end of the first inclined section is inserted below the shingles and the securing section is secured to the gutter, the first drainage section is positioned above an open end of the gutter for draining water thereinto. A second drainage section connects a front end of the second inclined section with the securing section. When the rear end of the first inclined section is inserted below the shingles and the securing section is secured to the gutter, the second drainage section is positioned above the open end of the gutter for draining water thereinto.

The first or second drainage sections, and preferably both, include a forwardly facing convex surface around which water travels; and at least one opening at a position below the forwardly facing convex surface through which water traveling around the forwardly facing convex surface exits into the gutter.

Specifically, the first drainage section includes an S-shaped bend including an upper forwardly facing convex surface over which water travels and a lower forwardly facing concave surface having the at least one opening therein. The upper forwardly facing convex surface has an upper edge connected with a front edge of the first inclined section, and the lower forwardly facing concave surface has a lower edge connected with a rear edge of the second inclined surface. Preferably, there are a plurality of openings in the lower forwardly facing concave surface that extend to a height which is at least equal to one-half the height of the lower forwardly facing concave surface, and more preferably, the openings also extend at least partially in the upper forwardly facing convex surface.

The second drainage section includes a channel below the forwardly facing convex surface thereof, and the at least one opening is provided in at least one wall of the channel. Preferably, there are a plurality of the openings in the at least one wall of the channel. More preferably, the channel is a U-shaped channel and the openings are provided in adjacent bottom and side walls of the channel. The securing section is connected with a front portion of the channel of the second drainage section.

The securing section includes an inverted U-shaped channel adapted to fit over a front upper edge of a gutter.

There is further a heating device positioned in the first drainage section for heating the gutter guard to melt any snow and ice thereon. The heating device includes a heating wire, and the heating wire is positioned at the lower forwardly facing concave surface. In one embodiment, the heating wire is fixed to the lower forwardly facing concave surface.

The above and other objects, features and advantages of the invention will become readily apparent from the following detailed description thereof which is to be read in connection with the accompanying drawings.

DETAILED DESCRIPTION

Figure 1:
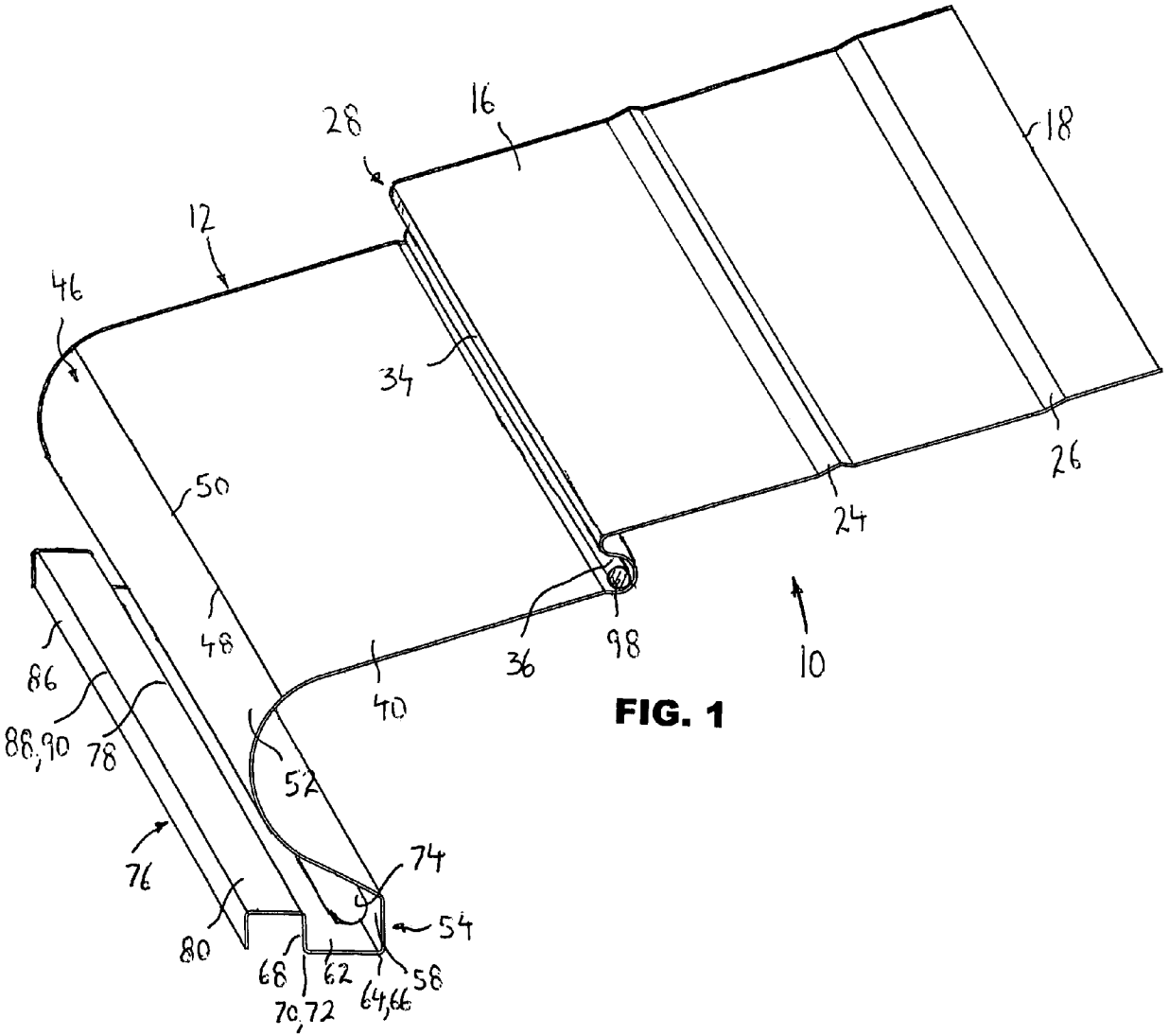
FIG. 1 is a perspective view of a gutter guard according to the present invention.
Figure 2:
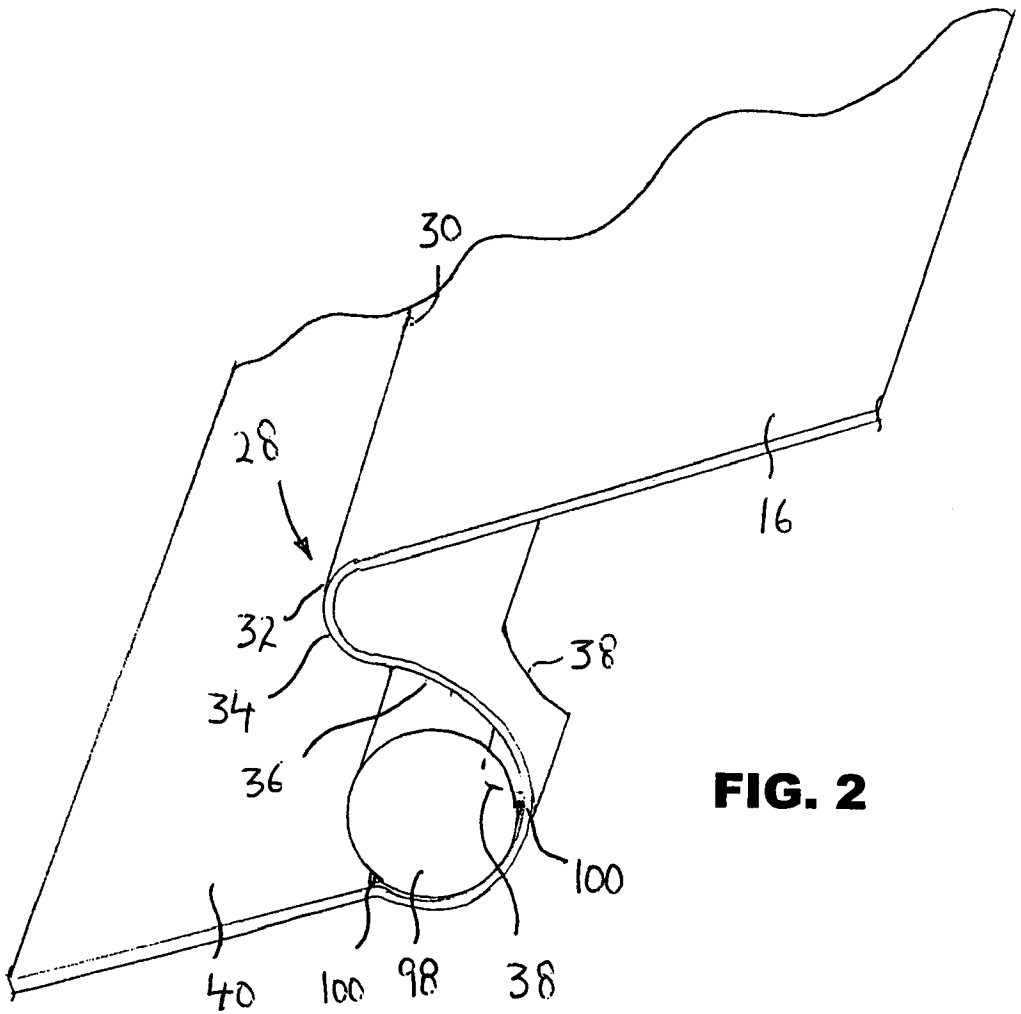
FIG. 2 is an enlarged perspective view of a portion of the gutter guard.

Referring to the drawings in detail, and initially to FIGS. 1–4 thereof, a gutter guard 10 according to the present invention includes an elongated thin metal sheet 12 bent in a particular manner for fitting over a gutter 14 to prevent leaves and other debris from entering gutter 14, while still permitting water to enter gutter 14. It will be appreciated that the side to side length of gutter guard 10 is preferably made of a generally very long section, for example, five feet long, and is merely shown in a reduced length scale for purposes of illustration herein. Further, in the general concept of the present invention, a material other than metal can be used, such as plastic or other water impervious material. Preferably, as will be appreciated from the discussion hereafter, the material is a heat conducting material.

Specifically, metal sheet 12 includes an upper inclined, substantially planar section 16 of a generally rectangular shape, having an inclination relative to the horizontal of about 15°–25°. The upper free edge 18 of upper inclined section 16 is intended to be slipped under shingles 20 or shakes on a roof 22 of a building, so that any rain water which falls from roof 22 continues falling on the upper surface of upper inclined section 16. Upper inclined section 16 extends at the same pitch as roof 22, and extends outwardly from roof 22 to a position above gutter 14. Upper inclined section 16 can also be formed with various small bends, such as the triangular shaped bend 24 or stepped bend 26 shown in FIG. 1. Bends 24 and 26 function as stiffening ribs. Triangular shaped bend 24 may also aid in slowing down the flow rate of any rain water.

An S-shaped bend 28 forming a first drainage section extends down from the lower edge 30 of upper planar section 16 such that the upper edge 32 of S-shaped bend 28 is integrally secured as one-piece with the lower edge 30 of upper planar section 16. S-shaped bend 28 thereby includes an upper forwardly facing convex surface 34 over which water travels and a lower forwardly facing concave surface 36. Concave surface 36 includes a plurality of openings 38 extending therealong. Although the openings are shown in an oval or oblong shape, the present invention is not limited thereby. Openings 38 also extend upwardly so that openings 38 preferably extend at least partially in upper convex surface 34. With such an arrangement, some of the water traveling from upper inclined section 16 to S-shaped bend 28, travels around upper convex surface 34 by means of surface tension and then travels through openings 38 into gutter 14. This reduces the amount of rain water traveling to the next section.

Metal sheet 12 further includes a lower inclined, substantially planar section 40 of a generally rectangular shape, having the same inclination relative to the horizontal of about 15°–25°. The upper edge 42 of lower planar section 40 is connected with the lower edge 44 of lower forwardly facing concave surface 36 of S-shaped bend 28. As a result of S-shaped bend 28, it will be appreciated that lower inclined planar section 40 is parallel with, but spaced lower than, upper inclined planar section 16.

A bullnose section 46 extends down from the lower edge 48 of lower inclined planar section 40 such that the upper edge 50 of bullnose section 46 is integrally secured as one-piece with the lower edge 48 of lower inclined planar section 40. Bullnose section 46 thereby includes a forwardly facing convex surface 52 over which water travels. With such an arrangement, the remaining-water traveling from lower inclined section 40 to bullnose section 46, travels around forwardly facing convex surface 52 by means of surface tension.

Metal sheet 12 further includes a U-shaped channel section 54 integrally formed at the lower edge 56 of bullnose section 46. Specifically, U-shaped channel section 54 includes a rear vertically oriented wall 58 having an upper edge 60 integrally secured as one-piece with the lower edge 56 of bullnose section 46, a lower horizontally oriented wall 62 having a rearward edge 64 secured as one-piece with the lower edge 66 of rear vertically oriented wall 58, and a front vertically oriented wall 68 having a lower edge 70 secured as one-piece with the forward edge 72 of lower horizontally oriented wall 62.

A plurality of openings 74 are formed at the connection between rear vertically oriented wall 58 and lower horizontally oriented wall 62. Openings 74 extend approximately to one-half the height of rear vertically oriented wall 58 and one-half the width of lower horizontally oriented wall 62. Although openings 74 are shown in an oval or oblong shape, the present invention is not limited thereby. With such an arrangement, the remaining water traveling from lower inclined section 40 to bullnose section 46, travels around forwardly facing convex surface 52 by means of surface tension and then travels through openings 74 into gutter 14.

Bullnose section 46 and U-shaped channel section 54 together from a second drainage section.

Figure 3:
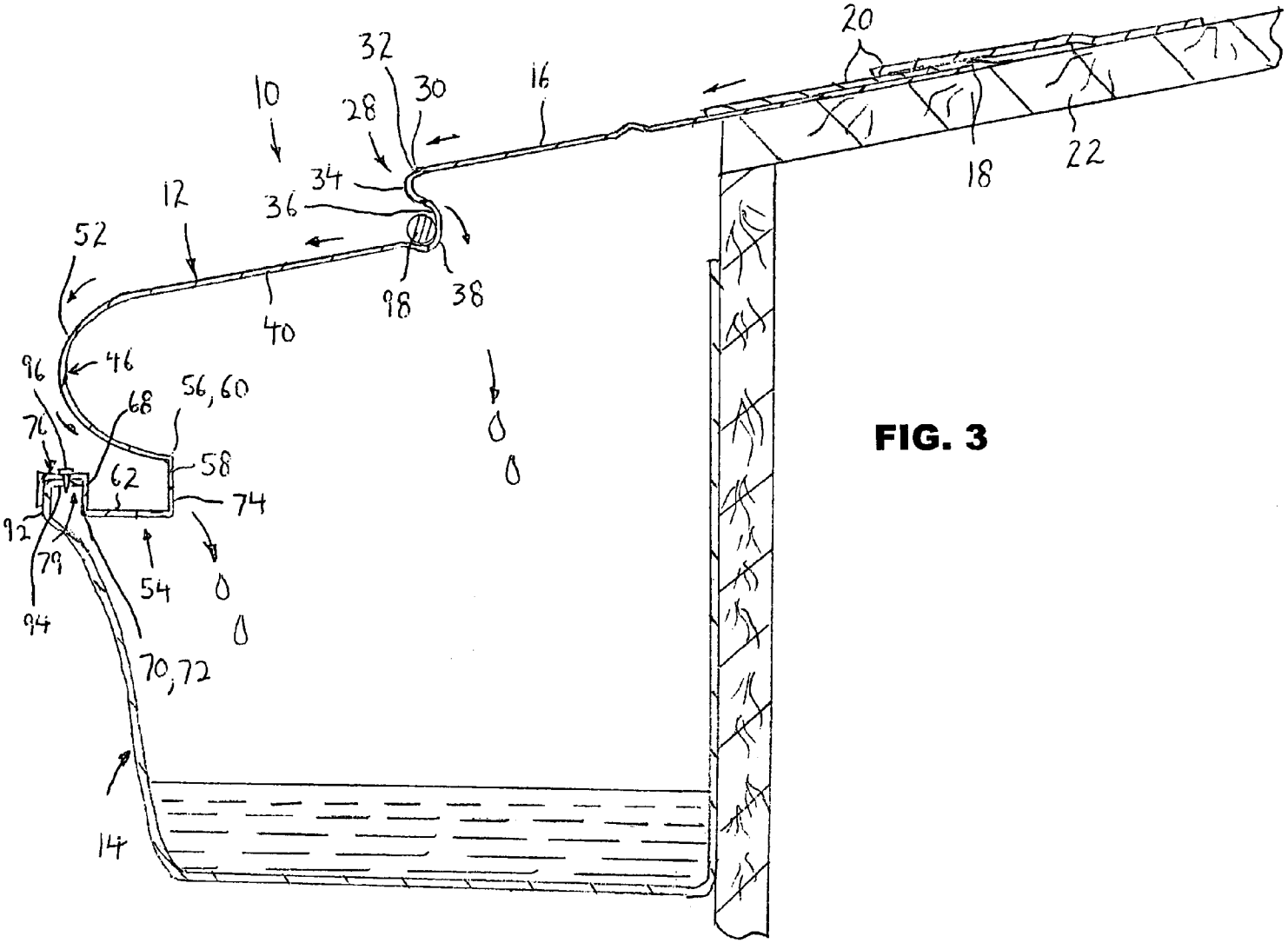
FIG. 3 is a cross-sectional view of the gutter guard in its installed condition.
Figure 4:
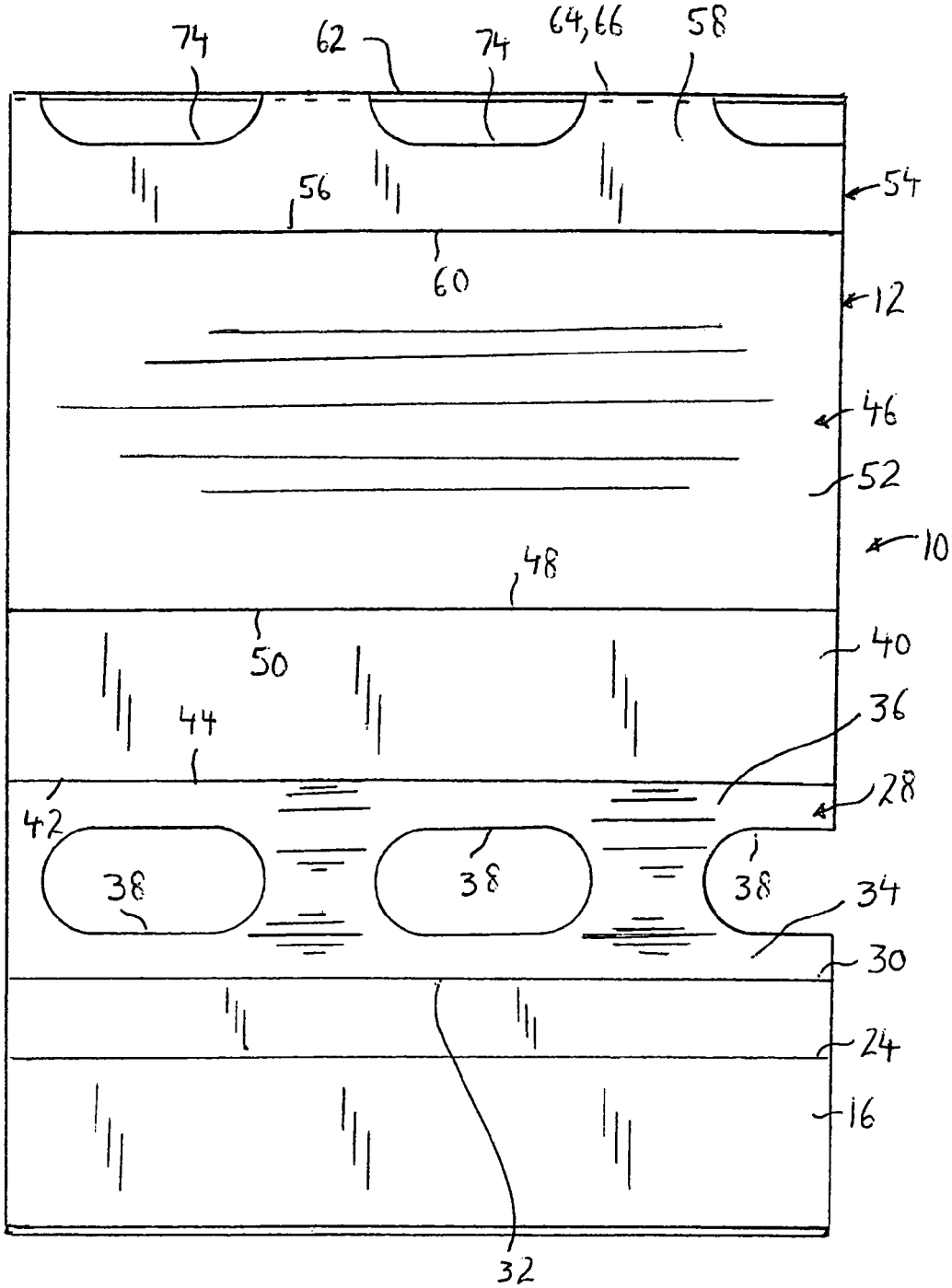
FIG. 4 is an elevational view of the gutter guard, viewed along line 4—4 of the FIG. 1.

Metal sheet 12 further includes an inverted U-shaped channel section 76 integrally connected as one-piece at the upper edge 78 of front vertically oriented wall 68, in order to secure the forward end of gutter guard 10 to the upper bent front end 79 of gutter 14, as shown in FIG. 3. Specifically, inverted U-shaped channel section 76 is formed by front vertically oriented wall 68, an upper horizontally oriented wall 80 having a rearward edge 82 secured as one-piece with the upper edge 78 of front vertically oriented wall 68, and a frontmost vertically oriented wall 86 having an upper edge 88 secured as one-piece with the forward edge 90 of upper horizontally oriented wall 80.

As shown in FIG. 3, the upper edge 79 of gutter 14 includes an inward L-shaped bent section formed from an upwardly extending wall 92 and a rearwardly extending horizontal wall 94 having its front edge secured to the upper edge of upwardly extending wall 92. Inverted U-shaped channel section 76 is preferably friction fit over the L-shaped bent section such that rearwardly extending horizontal wall 94 fits snugly between front vertically oriented wall 68 and frontmost vertically oriented wall 86, and is positioned immediately below upper horizontally oriented wall 80. In this manner, the rear end of gutter guard 10 is secured under roof shingles 20 and the front end of gutter guard 10 is secured to L-shaped bent section 90 of gutter 14. If desired, although not required, in order to provide a greater securement to gutter 14, nails, screws or the like 96 can secure upper horizontally oriented wall 80 to rearwardly extending horizontal wall 94.

With the arrangement thus far described, the rain falling from roof shingles 20 will fall along the upper surface of upper inclined section 16 to S-shaped bend 28. Some of the rain will travel around upper convex surface 34 by means of surface tension and then travel through openings 38 into gutter 14. This reduces the amount of rain water traveling to the next section. The remaining water will travel around forwardly facing convex surface 52 by means of surface tension and then travel through openings 74 into gutter 14. In this manner, during heavy downpours, S-shaped bend 28 and the openings 38 therein will reduce the amount of rain traveling around bullnose section 46. This will substantially reduce the possibility of rain falling off the roof from bullnose section 46.

In accordance with another aspect of the present invention, an insulated heating wire 98 is positioned in lower forwardly facing concave surface 36 of S-shaped bend 28, and secured thereto by adhesive 100 or the like. Alternatively, adhesive 100 can be eliminated, and heating wire 98 can be merely positioned in lower forwardly facing concave surface 36 of S-shaped bend 28.

Heating wire 98 heats the metal of metal sheet 12 of gutter guard 10 by being in contact therewith. As a result, any snow or ice that forms on gutter guard 10 is melted and does not impede the flow of water to gutter 14. Because of the S-shaped bend 28, heating wire 98 fits within lower forwardly facing concave surface 36 of S-shaped bend 28. This differs from conventional heating wires that are merely positioned on the upper exposed surface of the gutter guards where they are more readily exposed to the elements and can more easily become dislodged, and from heating wires that are formed at the lower surface of the gutter guards, which are more complicated and burdensome to assemble. With this arrangement of the present invention, heating wire 98 is less prone to escape from lower forwardly facing concave surface 36, and at the same time, is protected at least partially from the elements.

It will further be appreciated that, because openings 38 extend upwardly to an extent preferably at least partially in upper convex surface 34, the upper ends of openings 38 are at a height which is above heating wire 98. As a result, water traveling around upper forwardly facing convex surface 34, will fall through openings 38 before substantially hitting heating wire 98. The remaining water will fall like a waterfall onto lower planar section 40 without substantially impinging upon heating wire 98.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention defined by the appended claims.

What is claimed is:

1. A gutter guard comprising:

a first inclined section of water impervious material having a rear end adapted for insertion below shingles of a roof of a building;

a second inclined section of water impervious material;

a securing section for securing a front end of the gutter guard to a gutter of the building;

a first drainage section which connects a front end of the first inclined section to a rear end of the second inclined section and which, when the rear end of the first inclined section is inserted below the shingles and the securing section is secured to the gutter, is positioned above an open end of the gutter for draining water thereinto, said first drainage section including an S-shaped bend including an upper forwardly facing convex surface over which water travels and a lower forwardly facing concave surface connected directly to the upper forwardly facing convex surface and having at least one opening at a position below said forwardly facing convex surface through which water traveling around the forwardly facing convex surface exits into the gutter, and said at least one opening extends from a bottom of said lower forwardly facing concave surface to a height which is at least equal to one-half the height of said lower forwardly facing concave surface; and a second drainage section which connects a front end of the second inclined section with the securing section, and which, when the rear end of the first inclined section is inserted below the shingles and the securing section is secured to the gutter, is positioned above the open end of the gutter for draining water thereinto;

a heating device positioned in said first drainage section on an upper surface of said gutter guard for heating said gutter guard to melt any snow and ice thereon.

2. A gutter guard according to claim 1, wherein said second drainage section includes:

a forwardly facing convex surface around which water travels; and at least one opening at a position below said forwardly facing convex surface through which water traveling around the forwardly facing convex surface exits into the gutter.

3. A gutter guard according to claim 1, wherein said upper forwardly facing convex surface has an upper edge connected with a front edge of said first inclined section, and said lower forwardly facing concave surface has a lower edge connected with a rear edge of said second inclined surface.

4. A gutter guard according to claim 1, wherein there are a plurality of openings in said lower forwardly facing concave surface.

5. A gutter guard according to claim 4, wherein said openings also extend at least partially in said upper forwardly facing convex surface.

6. A gutter guard according to claim 2, wherein said second drainage section includes a channel below said forwardly facing convex surface thereof, and said at least one opening is provided in at least one wall of said channel.

7. A gutter guard according to claim 6, wherein there are a plurality of said openings in said at least one wall of said channel.

8. A gutter guard according to claim 7, wherein said channel is a U-shaped channel and said openings are provided in adjacent bottom and side walls of said channel.

9. A gutter guard according to claim 6, wherein said securing section is connected with a front portion of said channel of said second drainage section.

10. A gutter guard according to claim 1, wherein said securing section includes an inverted U-shaped channel adapted to fit over a front upper edge of a gutter.

11. A gutter guard according to claim 1, wherein said heating device includes a heating wire on said upper surface of said gutter guard.

12. A gutter guard according to claim 11, wherein said heating wire is positioned on said upper surface of said gutter guard at said lower forwardly facing concave surface.

13. A gutter guard according to claim 12, wherein said heating wire is fixed on paid upper surface of said gutter guard to said lower forwardly facing concave surface.

14. A gutter guard comprising:

a first inclined section of water impervious material having a rear end adapted for insertion below shingles of a roof of a building;

a second inclined section of water impervious material;

a securing section for securing a front end of the gutter guard to a gutter of the building;

a first drainage section which connects a front end of the first inclined section to a rear end of the second inclined section and which, when the rear end of the first inclined section is inserted below the shingles and the securing section is secured to the gutter, is positioned above an open end of the gutter for draining water thereinto, said first drainage section including an S-shaped bend including an upper forwardly facing convex surface over which water travels and a lower forwardly facing concave surface connected directly to the upper forwardly facing convex surface and having at least one opening therein at a position below said forwardly facing convex surface through which water traveling around the forwardly facing convex surface exits into the gutter;

a second drainage section which connects a front end of the second inclined section with the securing section, and which, when the rear end of the first inclined section is inserted below the shingles and the securing section is secured to the gutter, is positioned above the open end of the gutter for draining water thereinto, said second drainage section including a forwardly facing convex surface around which water travels and at least one opening at a position below said forwardly facing convex surface through which water traveling around the forwardly facing convex surface exits into the gutter; and a heating wire positioned on an upper surface of said gutter guard at said lower forwardly facing concave surface of said first drainage section for heating said gutter guard to melt any snow and ice thereon;

said at least one opening extends from a bottom of said lower forwardly facing concave surface to a height thereof which is above said heating wire such that said heating wire does not interfere with drainage of water through said at least one opening.

15. A gutter guard according to claim 14, wherein there are a plurality of openings in said lower forwardly facing concave surface of said S-shaped bend, and a plurality of openings in said forwardly facing concave surface of said second drainage section.

16. A gutter guard according to claim 14, wherein said at least one opening extends from a bottom of said lower forwardly facing concave surface to a height which is at least equal to one-half the height of said lower forwardly facing concave surface.

* * * * *